US009431191B2

(12) United States Patent
Cevik et al.

(10) Patent No.: US 9,431,191 B2
(45) Date of Patent: Aug. 30, 2016

(54) POSITION SWITCH

(71) Applicant: K.A. Schmersal Holding GmbH & Co. KG, Wuppertal (DE)

(72) Inventors: Yasar Cevik, Hagen (DE); Rudolf Popella, Hilden (DE); Matthias Banaszek, Wuppertal (DE)

(73) Assignee: K.A. Schmersal Holding GmbH & Co KG, Wuppertal (DE)

( * ) Notice: Subject to any disclaimer, the term of this patent is extended or adjusted under 35 U.S.C. 154(b) by 0 days.

(21) Appl. No.: 14/546,967

(22) Filed: Nov. 18, 2014

(65) Prior Publication Data

US 2015/0144472 A1 May 28, 2015

(30) Foreign Application Priority Data

Nov. 25, 2013 (DE) ..... 10 2013 019 597

(51) Int. Cl.

| | |
|---|---|
| ***H01H 3/20*** | (2006.01) |
| ***H01H 15/00*** | (2006.01) |
| ***H01H 21/22*** | (2006.01) |
| ***H01H 21/28*** | (2006.01) |

(52) U.S. Cl.

CPC ..... *H01H 21/22* (2013.01); *H01H 21/28* (2013.01); *H01H 2021/287* (2013.01); *H01H 2221/052* (2013.01)

(58) Field of Classification Search

CPC ..... H01H 29/02; H01H 29/20; H01H 28/02; H01H 21/28; H01H 2021/287; H01H 3/00; H01H 3/02; H01H 3/08; H01H 3/10; H01H 3/32; H01H 3/40; H01H 3/42; H01H 3/46; H01H 3/54; H01H 3/58; H01H 9/00; H01H 9/02; H01H 13/50; H01H 13/52; H01H 19/00; H01H 19/001; H01H 19/02; H01H 19/04; H01H 19/08; H01H 19/10; H01H 19/14; H01H 19/28; H01H 19/36; H01H 21/00; H01H 21/02; H01H 21/04; H01H 21/22; H01H 21/24; H01H 21/36; H01H 21/48; H01H 23/00; H01H 23/02; H01H 23/04; H01H 23/12; H01H 23/14; H01H 23/16; H01H 23/24; H01H 2003/00; H01H 2003/02; H01H 2003/08; H01H 2003/085; H01H 2003/10; H01H 2003/105; H01H 2003/32; H01H 2003/40; H01H 2003/46; H01H 2009/0088; F16B 7/04

USPC ..... 200/232

See application file for complete search history.

(56) References Cited

U.S. PATENT DOCUMENTS 6,518,522 B1 2/2003 Vinard et al.

FOREIGN PATENT DOCUMENTS

| | | |
|---|---|---|
| DE | 2036853 | 7/1970 |
| DE | 8225002 U1 | 10/1982 |

(Continued)

OTHER PUBLICATIONS

Extended European Search Report dated May 6, 2015 for International Patent Application No. 14003927.2-1808, all pages.

(Continued)

*Primary Examiner* — Renee Luebke
*Assistant Examiner* — Anthony R. Jimenez
(74) *Attorney, Agent, or Firm* — Kilpatrick Townsend & Stockton LLP

(57) ABSTRACT

Position switch having a pivoting-lever actuator which has a switching shaft supported in an actuating head, said switching shaft switching an actuating element in order to move a plunger of a switching element arranged in a switch housing, wherein a switch head is fastened to the switch housing, the actuating head being fixable in a locking manner to said switch head in different angular positions, for which purpose the actuating head is connectable to the switch head via a plug-in toothing, wherein the switch head and the actuating head have crown toothings which are fittable axially to one another and the teeth of which that are arranged circumferentially in a manner spaced apart from one another provide first and second planar toothings, and the teeth of the first planar toothing have tooth flanks that have a greater radial extent than the teeth of the second planar toothing.

18 Claims, 4 Drawing Sheets

(56) References Cited

FOREIGN PATENT DOCUMENTS

| | | | |
|---|---|---|---|
| DE | 60223640 | T2 | 11/2007 |
| DE | 60223640 | T2 | 10/2008 |
| JP | 11167844 | A | 6/1998 |

OTHER PUBLICATIONS

First Office Action corresponding to DE102013019597.7, filed Nov. 25, 2013.

POSITION SWITCH

CROSS REFERENCE TO RELATED APPLICATIONS

This application claims priority to DE 10 2013 019 597.7, filed Nov. 25, 2013, the complete disclosure of which is herein incorporated by reference.

FIELD OF THE INVENTION

The invention relates to a position switch according to the preamble of Claim 1.

BACKGROUND OF THE INVENTION

DE 602 23 640 T2 discloses a position switch which has a housing in which a device that is able to move translationally and an electric switch assembly that is actuable by this device are arranged. A manoeuvre head is fitted so that it is removable and angularly variable in a recess of the housing, said recess opening out onto a fitting surface of the housing. For this purpose, the manoeuvre head has a tubular bearing surface which houses a push button which is actuated directly or indirectly by an object and is able to slide along the translation axis in order to interact with the movable device.

It is known here that it is often desirable to be able to adjust the position of the manoeuvre head of such a switch. Such adjustment may be necessary for example when it is desired to mount the switch in a predetermined position. For this purpose, the manoeuvre head has an external toothing with outer notches which interact with inner notches of an internal toothing which is provided in the recess in the housing or the opening of the housing. The inner notches can be provided at the same intervals or at multiple intervals with respect to the external toothing, in order to increase the diversity of uses.

In the case of a position switch known from JP H11-167 844 A, a pivoting lever is fixable in different angular positions on a shaft of the position switch by means of a crown toothing. Finally, DE 20 36 853 A furthermore discloses to fix housings of signalling devices so as to be settable at any desired angle to one another by means of a crown toothing.

However, it is a disadvantage that toothings having an external and an internal toothing demand flawless pairings, with the result that the design is complex. This is the case in particular when an angular and rotationally locked assignment of actuating head and housing to one another shall be possible in the entire pivoting range of preferably 360° in selectable steps in accordance with the tooth pitch.

SUMMARY OF THE INVENTION

It is therefore the object of the invention to provide a position switch of the stated type, which allows improved arranging and blocking of the actuating head on the housing in correct angular positions.

This object is achieved by the features of Claim 1.

Hereby a position switch is provided in which the actuating head can be positioned and blocked via an axially effective, planar surface toothing on the switch housing. Here, the teeth mesh with one another in a planar manner in the sense of a form-fitting, releasable coupling. The teeth are arranged radially and position the actuating head with respect to the switch housing. The number of teeth arranged in a circumferentially distributed manner is selectable. The full force-locking connection can be achieved by an axial bracing of the plug-in toothing.

Thus, according to the invention an end toothing is provided which can absorb more force on account of the fact that the teeth of a first planar toothing have a greater radial extent than the teeth of a second planar toothing. The tooth flanks of the teeth of the first planar toothing provide bearing surfaces which provide a secure force-locking and form-locking connection of a toothing of compact design by way of a radial oversize with respect to the second planar toothing. Preferably, the radial oversize is limited to an outer thickness portion of the tooth-head. As a result, the tooth root is enlarged with respect to the tooth head. The teeth of the second planar toothing are then quasi embedded between the teeth of the first planar toothing.

The first planar toothing can be provided on the actuating head or on a switch head being provided on the switch housing. The second planar toothing is then provided on the other component in each case.

For an axial bracing of the toothing, a sleeve-like extension, which is lockable to the switch housing via a locking plate when the toothing is axially effective, can be provided on the actuating head.

Further configurations of the invention can be gathered from the following description and the dependent claims.

The invention is explained in more detail hereinafter with reference to the exemplary embodiment illustrated in the appended drawings.

DESCRIPTION OF THE SPECIFIC EMBODIMENTS

The invention relates to a position switch. The position switch comprises, in a known manner, an actuator 1 having an actuating head 2 and a switching element (not illustrated) contained in a housing. In order to configure the position switch with a safety function, the connection between the actuator 1 and the switching element should be made in a rigid manner. The switching element has a plunger (not illustrated) on which the actuator 1 acts. Usually, when the position switch is actuated, the plunger of the switching element is pushed downwards, i.e. a translatory movement is carried out.

Figure 1:
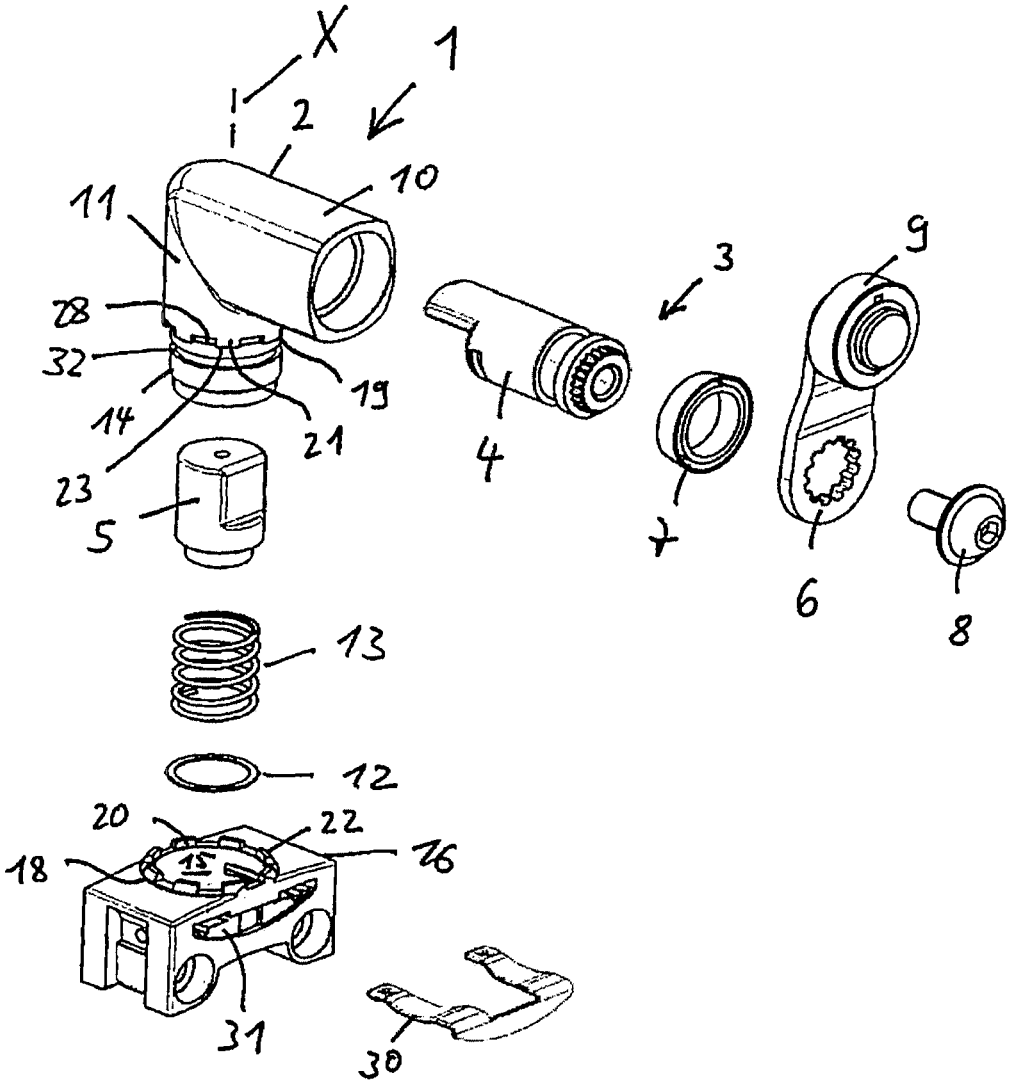
FIG. 1 schematically shows an exploded view of an actuating head with a pivoting-lever actuator and a switch head of a position switch.
Figure 2:
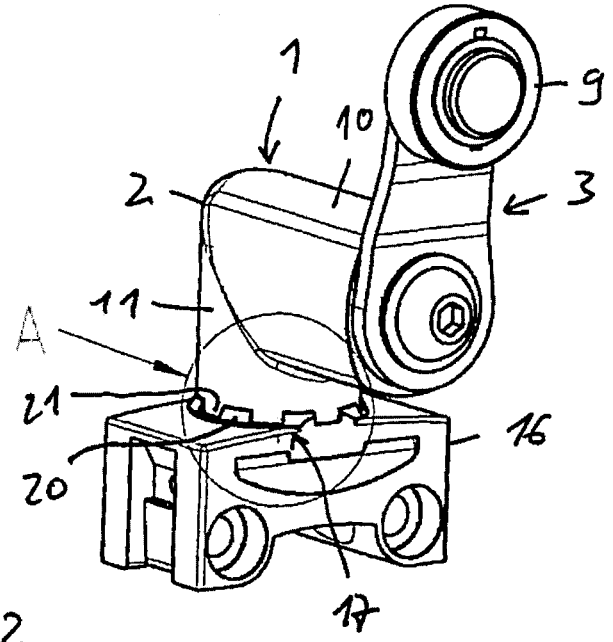
FIG. 2 shows a perspective view of the individual parts according to FIG. 1 in the assembled state.

As shown in FIG. 1 and FIG. 2, the position switch comprises a pivoting-lever actuator 3 which has a switching shaft 4 supported in the actuating head 2, said switching shaft 4 switching an actuating element 5 in order to move the plunger of the switching element of a switch which is arranged in the switch housing and has for example normally closed and/or normally open contacts (not illustrated). According to FIG. 1, the actuating element 5 is, for example, a pressure plate which slides along the translation axis X upon actuation.

The pivoting-lever actuator 3 comprises a lever 6 which is fastenable to the switching shaft 4 via a connection ring 7, for example by means of a screw 8. In a conventional manner, the lever 6 carries on its free end a roller 9, which is hit by an object (not illustrated) which actuates the position switch. In an alternative exemplary embodiment which is not illustrated, the lever 6 can be reduced to the roller 9.

The actuating head 2 preferably is generally L-shaped, the one limb 10 of which accommodates the switching shaft 4 in a rotatable manner and the other limb 11 of which accommodates the pressure plate 5 with a press-in disc 12 and a pretensioning spring 13. At its lower end, the limb 11 narrows to form a tubular extension 14 which is inserted into a cutout 15 in a switch head 16 during assembly.

The switch head 16 is intended to be fastened to the switch housing (not illustrated). The actuating head 2 is fixable in a locking manner to the switch head 16 in different angular positions, for which purpose the actuating head 2 is connectable to the switch head 16 via a plug-in toothing 17 (cf. FIG. 2).

According to the invention, the plug-in toothing 17 is provided as follows. The switch head 16 and the actuating head 2 have crown toothings 18, 19 which are fittable axially into one another and the teeth 20, 21 of which that are arranged circumferentially in a manner spaced apart from one another provide first and second planar toothings 22, 23. The teeth 20 of the first planar toothing 22 have tooth flanks 24 that have a greater radial extent 25 than the teeth 21 of the second planar toothing 23. According to the exemplary embodiment illustrated, the first planar toothing 22 is provided preferably on the switch head 16. According to an alternative exemplary embodiment that is not illustrated, the first planar toothing can be provided on the actuating head 2.

The first and second planar toothings 22, 23 are preferably arranged as crown toothings on the switch head 16 and the actuating head 2, respectively, with radially extending teeth 20, 21. The teeth 20, 21 being circumferential segments that are arranged in a spaced-apart manner can have a parallel-faced or pointed tooth shape.

As is shown in particular in FIG. 1, the actuating head 2 preferably has the crown toothing 19 at the point at which the extension 14 adjoins the limb 11. In order that the crown toothing 19 forms an end toothing, the extension 14 has a smaller diameter than the limb 11.

The crown toothing 19 is thus provided in an annular manner at the transition region from the limb 11 to the extension 14. The switch head 16 provides the crown toothing 18 on the head side above the opening of the cutout 15.

Figure 3:
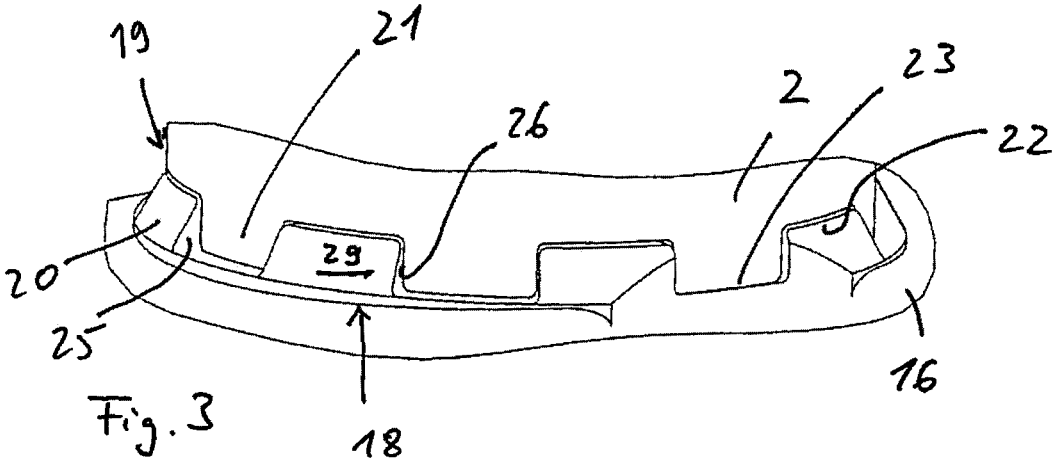
FIG. 3 shows an enlarged illustration of the detail A according to FIG. 2.
Figure 4:
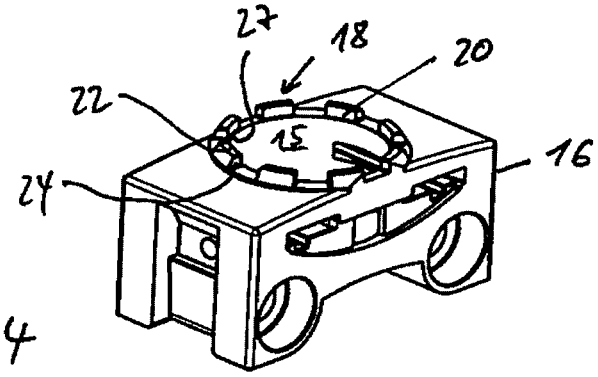
FIG. 4 shows an enlarged illustration of the switch head according to FIG. 2.

As is shown in particular in FIG. 3, the radially extending tooth flanks 24 of the respective first planar toothing 22 preferably have a trapezoidal shape. The radially extending tooth flanks 26 of the respective second planar toothing 23 preferably have a rectangular shape. The greater radial extent of the teeth 20 of the respective first planar toothing 22 is preferably provided as a root-side widening. This is illustrated in particular in FIG. 3. FIG. 3 further illustrates that such a radial extension of the teeth of the respective first planar toothing 22 with respect to the translation axis X in conjunction with a bevelled outer tooth side 29 allows the first planar toothing 22 to be attached to the actuating head 2 in a base-like manner.

Preferably, the first planar toothing 22 is positioned in a manner offset radially towards the outside with respect to an inner circumferential contact area 27. This contact area 27 is preferably assigned to a radial spacer ring 28 on which the second planar toothing 23 is then preferably arranged. The spacer ring 28 can define a coupling depth of the plug-in toothing 17 with respect to the contact area 27. For an axial force-locking connection of the plug-in toothing 17, it is then not necessary for the tooth heads of the teeth 20, 21 each to be in contact with the respective other planar toothing 22, 23. The form-locking connection achieved by the teeth 20, 21 is sufficient.

For an axial bracing of the plug-in toothing 17 a locking plate 30 is provided, for example, which is insertable into a recess 31 in the switch head 16 and comes into engagement with an engagement groove 32 on the extension 14 of the actuating head 2.

The invention claimed is:

1. Position switch comprising a pivoting-lever actuator which has a switching shaft supported in an actuating head, said switching shaft switching an actuating element in order to move a plunger of a switching element arranged in a switch housing, wherein a switch head is fastened to the switch housing, the actuating head being fixable in a locking manner to said switch head in different angular positions, for which purpose the actuating head is connectable to the switch head via a plug-in toothing, wherein the switch head and the actuating head each have crown toothings which are fittable axially to one another and the teeth of which that are arranged circumferentially in a manner spaced apart from one another provide a switch head planar toothing and an actuating head planar toothing, wherein the teeth of the switch head planar toothing have tooth flanks with a first radial extent and the teeth of the actuating head planar toothing have tooth flanks with a second radial extent, and wherein the first radial extent is greater than the second radial extent.

2. Position switch according to claim 1, wherein the switch head planar toothing is arranged as a crown toothing on the switch head.

3. Position switch according to claim 1, wherein the switch head planar toothing is arranged as a crown toothing on the actuating head.

4. Position switch according to claim 1, wherein the teeth are provided as circumferential segments with a parallel-faced or pointed tooth shape.

5. Position switch according to claim 1, wherein the radially extending tooth flanks of the switch head planar toothing have a trapezoidal shape.

6. Position switch according to claim 5, wherein the radially extending tooth flanks of the actuating head planar toothing have a rectangular shape.

7. Position switch according to claim 1, wherein the switch head planar toothing is positioned in a manner offset radially towards the outside with respect to an inner circumferential contact area.

8. Position switch according to claim 7, wherein the actuating head planar toothing is arranged on a radial spacer ring which defines a coupling depth of the plug-in toothing relative to the contact area.

9. Position switch according to claim 1, wherein the first radial extent comprises a root-side widening extent.

10. Position switch according to claim 1, wherein an axial bracing of the plug-in toothing is provided by means of a locking plate.

11. A position switch, comprising:

an actuating head comprising a first plurality of teeth with first tooth flanks having a first radial extent, wherein the first plurality of teeth extend about an entire circumference of the actuating head;

a pivoting-lever actuator coupled to the actuating head, the pivoting-lever actuator comprising a switching shaft supported in the actuating head, the switching shaft configured to move an actuating element in order to move a plunger of a switching element; and a switch housing configured to house the switching element, the switch housing comprises a second plurality of teeth that extend completely around an aperture defined by the switch housing, wherein the second plurality of teeth and the first plurality of teeth are configured to axially couple together in different angular positions, the second plurality of teeth comprise second tooth flanks with a second radial extent, and wherein the second radial extent of the second tooth flanks is greater than the first radial extent of the first tooth flanks.

12. The position switch of claim 11, wherein the first plurality of teeth and the second plurality of teeth are provided as circumferential segments with a parallel-faced or pointed tooth shape.

13. The position switch of claim 11, wherein the second tooth flanks have a trapezoidal shape.

14. The position switch of claim 11, wherein the first tooth flanks have a rectangular shape.

15. The position switch of claim 11, wherein the second plurality of teeth extend axially from an exterior surface of the switch housing.

16. The position switch of claim 11, wherein the first plurality of teeth couple to a spacer ring on the actuating head, and wherein the spacer ring defines an axial coupling depth between the first plurality of teeth and the second plurality of teeth.

17. The position switch of claim 11, wherein the second radial extent is a root-side widening extent.

18. The position switch of claim 11, comprising a locking plate that blocks separation of the first plurality of teeth from the second plurality of teeth.

* * * * *